US005900836A

United States Patent [19]

Nishikawa et al.

[11] Patent Number: 5,900,836

[45] Date of Patent: * May 4, 1999

[54] TRACKING ANTENNA SYSTEM

[75] Inventors: Kunitoshi Nishikawa, Gifu-ken; Tomohisa Harada, Aichi-ken; Toshiaki Watanabe, Owariasahi; Masaru Ogawa, Aichi-ken, all of Japan

[73] Assignee: Kabushiki Kaisha Toyota Chuo Kenkyusho, Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/624,802

[22] Filed: Mar. 27, 1996

[30] Foreign Application Priority Data

Mar. 31, 1995 [JP] Japan ..... 7-074285

[51] Int. Cl.[6] ..... H01Q 3/00

[52] U.S. Cl. ..... 342/359

[58] Field of Search ..... 342/359

[56] References Cited

U.S. PATENT DOCUMENTS

| | | | |
|---|---|---|---|
| 4,725,843 | 2/1988 | Suzuki et al. | 342/359 |
| 5,227,806 | 7/1993 | Eguchi | 343/765 |
| 5,463,402 | 10/1995 | Walrath et al. | 342/359 |
| 5,557,285 | 9/1996 | Bender et al. | 342/359 |

FOREIGN PATENT DOCUMENTS

| | | |
|---|---|---|
| 1-092677 | 4/1989 | Japan . |
| 3-175385 | 7/1991 | Japan . |
| 4-64074 | 2/1992 | Japan . |
| 4-174385 | 6/1992 | Japan . |
| 4-198784 | 7/1992 | Japan . |
| 4-232483 | 8/1992 | Japan . |
| 5-67985 | 3/1993 | Japan . |
| 5-142321 | 6/1993 | Japan . |
| 7-240618 | 9/1995 | Japan . |

*Primary Examiner*—Theodore M. Blum

*Attorney, Agent, or Firm*—Oblon, Spivak, McClelland, Maier & Neustadt, P.C.

[57] ABSTRACT

A control portion performs gyro control at control intervals of $\Delta t$, by using $-\omega G$, which is obtained by inverting the polarity of an angular rate $\omega G$ outputted from an angular rate sensor portion. On the other hand, a receiving level is detected at constant control intervals of $\Delta T$ ($=M\Delta t$: M is an integer). The rotation of an antenna portion is controlled by using $\omega s$, if the receiving level has increased, or by using $-\omega s$, if the receiving level has decreased, i.e. by step track control. By accumulating the control amount $\pm\omega s$ for a predetermined long time period of $N\Delta T$, accumulation of an error contained in each angular rate $\omega G$ is obtained. The accumulated value is then divided by N to calculate an error $\Delta\omega G$ contained in $\omega G$. This error $\Delta\omega G$ is used to compensate the actual error, so that the gyro control can be made more accurate.

12 Claims, 4 Drawing Sheets

CONTROL TIMING FOR SATELLITE TRACKING CONTROL SYSTEM

TRACKING ANTENNA SYSTEM

BACKGROUND OF THE INVENTION

1. Field of the Invention

The present invention relates to a tracking antenna system mounted on a mobile for tracking a radio source, and more particularly to a tracking antenna system which tracks a target on the basis of both strength of received radio wave and a turning angular rate of the mobile.

2. Description of the Related Art

A tracking antenna system for tracking a radio source, e.g. a satellite by using both step track control, in which tracking is carried out based on the receiving signal level while changing the beam direction of the antenna by a predetermined amount, and gyro control, in which the turning angular rate of the mobile is used to track the target, has been known. Hereinafter, a control operation based on an output from a gyro which detects a turning angular rate of a mobile will be referred to as "gyro control"; whereas a control operation using the detected receiving signal level while changing the beam direction of the antenna by a predetermined amount will be referred to as "step track control". In such a tracking antenna system, a control operation using both receiving level signal and angular rate signal is performed when the satellite can be seen, whereas a control operation using only the angular rate signal is performed when a radio wave from the satellite is blocked by buildings, tunnels and so on.

However, the tracking antenna system of the above-mentioned type raises, for example, the following problem: if only the gyro control is performed for a certain time period while a radio wave is blocked, the beam direction of the antenna gradually deviates from the satellite direction, due to effects of an error contained in a gyro output, and the antenna eventually loses the satellite. As a result, it takes a long time to search the direction of the satellite when the satellite comes into sight again.

Japanese Laid-Open Patent Publication 5-142321 discloses an approach for overcoming such a problem of an error contained in a gyro output as described above. In this approach, a triangular wave which increases or decreases in synchronization with a binary signal (a control amount for antenna rotation with a positive or negative constant step) generated in the step track control, is superposed on a gyro output. The signal on which a triangular wave is superposed is then used to increase or decrease the rotation angular rate of the antenna. The above approach utilizes the fact that, since the length of the positive period of the binary signal is different from the length of the negative period of the binary signal when a gyro output contains an error, the average value of the triangular wave gradually changes and eventually converges on an error in the gyro output. It is thus possible to correct the gyro output. Further, when the radio wave is blocked, binary signals are generated alternately at a constant cycle to maintain the previous correction state. The gyro output is corrected as described above, so that the tracking of the satellite can be appropriately performed.

In the foregoing prior art, however, the antenna continues to move around the axis running in the satellite direction, even after the average value of the triangular wave coincides with the gyro output error. As a result, if the antenna system is used in a place where the peak value of a receiving level is low, the receiving level lowers when the azimuth of the antenna beam deviates from the satellite direction, which generates noise in a TV screen display.

SUMMARY OF THE INVENTION

The present invention is directed to overcome the aforementioned problems of the prior art. It is therefore an object of the present invention to provide a system for controlling a satellite tracking operation by using both a step track control and a gyro control, in which a preferable tracking performance can be obtained by correcting an error contained in a gyro output.

In the control operation by a gyro control portion (i.e., gyro control), the beam direction of the antenna is controlled such that the change in the azimuth of the mobile is canceled. For this reason, the beam direction of the antenna varies smoothly. The beam direction of the antenna is generally controlled by rotating the antenna by a stepping motor or the like. In the gyro control, since the load of the stepping motor or the like does not change rapidly, it is possible to track the satellite appropriately even when the mobile turns at a relatively high speed. In an actual system, however, the turning angular rate of the mobile detected by the angular rate sensor portion may contain defects due to an offset error and a temperature drift, or a control amount for an angular rate for rotating the antenna may not coincide with the actual rotation amount of the antenna. It is thus necessary to redirect the beam of the antenna to the radio source (e.g. a satellite) at appropriate time points by using some means.

Further, in the gyro control, a time interval between control operations (hereinafter referred to as a "control interval") is preferably set to as small a value as possible. This is because the azimuth error can be reduced even with a rapid change of the turning angular rate, as long as the control interval is short.

On the other hand, in the control operation by the step track control portion (i.e., step track control), the antenna is rotated in the azimuth direction by a step angular rate, generally only by a slight amount, to detect an increase or decrease of the receiving level. The antenna is then rotated in the direction where the receiving level goes up.

More specifically, the receiving level is detected at constant intervals $\Delta T$. If the current receiving level is higher than the receiving level at a time $\Delta T$ before the current time, the antenna is rotated at a constant step angular rate $\omega s$ in the same direction as it was rotated after detecting the level at a time $\Delta T$ before. If the current receiving level comes down, the antenna is rotated at a constant step angular rate $\omega s$ in the opposite direction.

In order to make the beam direction of the antenna to follow the high-speed turning of the mobile by means of the step track control, it is necessary to set the step angular rate $\omega s$ to a value which is approximately the same as the turning angular rate of the mobile. In the actual system, however, the rotatable portion of an antenna, a turn table, or the like has moment of inertia and therefore it is difficult to rotate the antenna or the like stepwise and at a high speed. Because of this, it is often impossible to make the antenna beam follow the high speed turning of the mobile by the step track control.

Further, in the step track control, if the control interval $\Delta T$ is too short, the variation of the receiving level becomes small, and the control direction is affected by an additional thermal noise. As a result of this, the beam direction may deviate completely from the satellite direction. Therefore, it is preferable to set the control interval $\Delta T$ to be relatively large.

The present invention provide a tracking antenna system mounted on a mobile for tracking a radio source by controlling a beam direction of an antenna, comprising an angular change detector for detecting an angular change in an azimuth direction of the mobile, a first controller for controlling the beam direction of the antenna in accordance with the angular change detected by the angular change detector, a receiving level detector for detecting a receiving level of a radio wave, a second controller for controlling the beam direction of the antenna in accordance with a result from the receiving level detector, an error detector for detecting an error in the angular change detected by the angular change detector on the basis of a control result of the second controller, and a corrector for correcting the angular change detected by the angular change detector by using the error detected by the error detector.

Preferably, the error detector may include an error estimator which accumulates the error detector includes an error estimator which accumulates step angular rate signals a plurality of times, to calculate an error in the angular rate on the basis of the accumulated value.

The present invention controls a satellite tracking operation in the following manner: the change in the azimuth due to the turning of a mobile is canceled by using a first controller, or a gyro output, and then an azimuth error remaining uncancelled by the gyro control is further canceled by using a second controller, or a step track control.

Specifically, the value $-\omega G$, obtained by inverting the polarity of the turning angular rate $\omega G$ of the mobile detected by the gyro, the value $\pm\omega s$, obtained by multiplying a constant step angular rate $\omega s$ by a polarity determined by comparison between the current receiving level and the receiving level at a time $\Delta T$ before the current time, are added to find a sum $(-\omega G\pm\omega s)$. The sum $(-\omega G\pm\omega s)$ is then used to control the rotation of the antenna portion.

Preferably, the control amount $\pm\omega s$ for the step track control is updated at control intervals $\Delta T$ ($=M\times\Delta t$: M is an integer), which is longer than the control interval $\Delta t$ for the gyro control. As a result of this, both the step track control and the gyro control can be utilized most effectively, so that the satellite tracking can be performed appropriately even in a mobile which turns at a high speed.

In the present invention, in the step track control operation, the control amount $\pm\omega s$ obtained for every $\Delta T$ is used to calculate an offset error contained in a gyro output, which is to be compensated.

More specifically, if the angular rate output $\omega G$ used for the gyro control contains an offset error $\Delta\omega G$, the resultant rotation amount of the antenna (for a relatively long period of time T) becomes $\Delta\omega GT$. On the other hand, if the beam direction is orientated to the satellite direction due to the step track control even after T has elapsed, the amount by which the antenna rotates under the step track control must coincide with the error $\Delta\omega GT$. Assuming that the control interval for the step track control is $\Delta T$ and that $T=N\Delta T$, $\Delta\omega GT$ equals the value obtained by accumulating the control amount $\pm\omega s$ (step angular rate) N times. Therefore, the following expression can be obtained:

$$\Delta\omega GT = a1\omega s\Delta T + a2\omega s\Delta T + a3\omega s\Delta T + \ldots + ai\omega s\Delta T + \ldots aN\omega s\Delta T = \Sigma ai\omega s\Delta T \quad (i = 1 - N)$$

On the other hand, $T=N\Delta T$, and $\Delta\omega G=(1/N)\ \Sigma ai\omega s\ (i=1-N)$.

It is thus possible to calculate an error contained in a gyro output. The error $\Delta\omega G$ is then added to $-\omega G$ obtained by inverting the polarity of the gyro angular rate, to compensate the error contained in the gyro output. This eliminates the possibility of the beam direction of the antenna easily deviating from the satellite direction, even when only the gyro control is performed. In this manner, it is possible to reduce the number of control operations using the step track control to a minimum.

More specifically, when the receiving level is close to the peak value, only the gyro control is performed so that the number of step track control operations can be further reduced. As a result, it is possible to effectively prevent noise associated with the beam control, even when the antenna is used in a place where the peak value of the receiving level is low.

For example, a decision portion decides whether or not the receiving level falls within a predetermined range, and the step track control operation is prohibited if the receiving level is outside this range. It is thus possible to eliminate unnecessary step track control operations, thereby reducing the number of antenna control steps.

Further, the number of control operations based on the step track control can be also reduced by permitting the step track control operation only after a predetermined interval.

DESCRIPTION OF THE PREFERRED EMBODIMENTS

Preferred embodiments of the present invention will be described with reference to the accompanying drawings.

Figure 1:
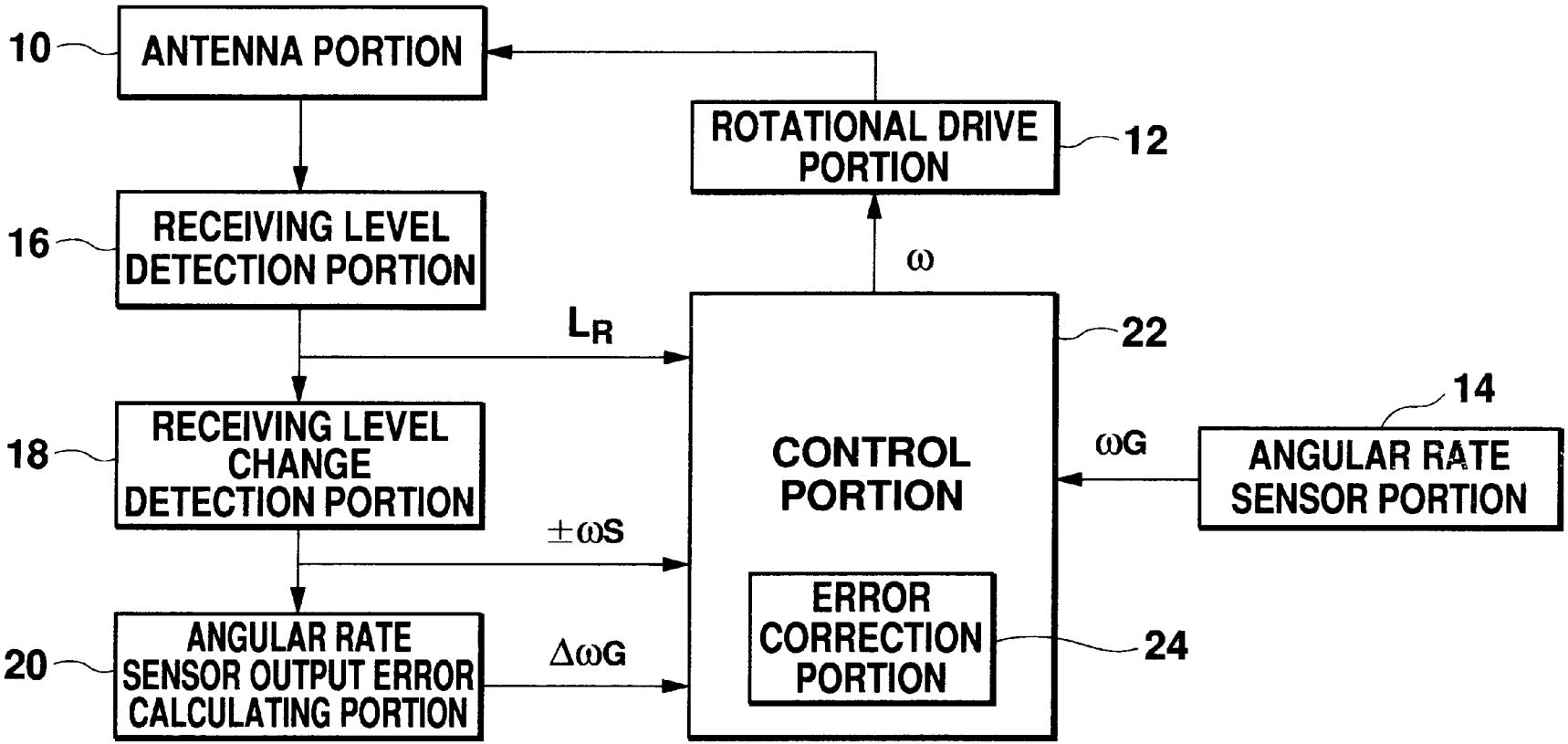
FIG. 1 is a block diagram illustrating a structure of a tracking antenna system in accordance with one embodiment of the present invention.

FIG. 1 is a block diagram which illustrates a structure according to one embodiment of the present invention. As shown, a tracking antenna system of this embodiment comprises seven functional portions: an antenna portion 10; a rotational drive portion 12; an angular rate sensor portion 14; a receiving level detection portion 16; a detection portion of a receiving level change 18; an output error calculating portion of an angular rate sensor 20; and a control portion 22.

The antenna portion 10 is mounted, for example, on the roof of a mobile and receives radio waves from a satellite. The antenna portion 10 is driven by the rotational drive portion 12 to rotate in azimuth directions. For example, the beam of the antenna portion 10 is rotated in azimuth directions when a turntable which supports the antenna portion 10 is rotated by a stepping motor. Alternatively, the antenna portion 10 may be formed by an array antenna comprising phase-controllable antenna elements. In this case, the beam is electronically rotated.

The angular rate sensor portion 14, which is generally composed of a gyro, detects an angular rate (yaw-rate) from the azimuth of the vehicle, and outputs an angular rate signal $\omega G$. Hereinafter, the angular rate sensor portion may be appropriately referred to simply as a "gyro". The receiving level detection portion 16 detects the level of a radio wave received by the antenna portion 10 and outputs a receiving level signal LR which is proportional to the detected value. The receiving level change detection portion 18 detects a change in the receiving level signal LR detected by the receiving level detecting portion 16 for every step-track control timing interval, and outputs either +ωs or −ωs as a step angular rate signal, according to the direction of the detected change. Specifically, if the receiving level change detection portion 18 detects a decrease of the receiving level, the polarity of the current step angular rate signal is inverted. On the other hand, if the receiving level change detection portion 18 detects an increase, the polarity of the current output is maintained. The step angular rate signal ±ωs is a control amount for controlling the rotation rate of the antenna portion 10 during the step track control. Thus, during the step track control, the rotation rate of the antenna portion 10 is controlled by using the magnitude of the step angular rate signal ωs as a step width.

The angular rate sensor output error calculating portion 20 uses the step angular rate signal ±ωs outputted from the receiving level change detection portion 18 to calculate an error contained in the output of the angular rate sensor portion 14. The calculation result is then outputted as an error signal ΔωG. The control portion 22 receives an angular rate signal ωG from the angular rate sensor 14, a receiving level signal LR from the receiving level detection portion 16, a step angular rate signal ±ωs from the receiving level change detection portion 18, and an error signal ΔωG from the angular rate sensor output error calculating portion 20, and calculates the control amount of the azimuth of the antenna portion 10 on the basis of these received signals. The calculated control amount is then supplied to the rotational drive portion 12 as a rotation angle signal ω. The control portion 22 includes an error correction portion 24, which corrects the angular rate signal ωG from the rate sensor 14 by means of the error signal ΔωG supplied from the rate sensor output error calculating portion 20. The control portion 22 then controls the rotational drive portion 12 on the basis of the corrected angular rate, thereby controlling the direction of the antenna portion 10.

As stated, in the angular rate sensor output error calculating portion 20, an error ΔωG, more precisely, an offset error, which is contained in the angular rate signal ωG, is calculated from the step angular rate signal ±ωs outputted from the receiving level change detecting portion 18. The method of calculating the offset error ΔωG will now be described.

It is assumed that the beam of the antenna portion 10 is directed toward the satellite at a certain point in time and that the output of the rate sensor portion 14, i.e., an angular rate signal ωG, contains an offset error ΔωG. Under these conditions, if the tracking control is performed by using only the output of the rate sensor portion 14, ωG, the azimuth of the beam of the antenna portion 10 deviates from the satellite direction by ΔωG.T, after a sufficiently long period of time T has elapsed. Actually, however, since the tracking control based on the step track control with control interval ΔT is also performed, the antenna portion 10 gradually rotates at a rotation angular rate being increased or decreased by ±ωs for every ΔT, so that the beam of the antenna portion 10 is directed toward the satellite after the time period T has elapsed. Therefore, by accumulating step angular rate signals ±ωs for every ΔT, the angle, by which the antenna portion 10 rotates during the time period T as a result of the step track control, can be found. This angle represents the accumulation of errors contained in each output from the rate sensor portion 14 for the time period T. Therefore, by dividing the accumulated value by the number of accumulation steps, an offset error ΔωG in an output of the rate sensor portion 14 can be obtained.

Thus, ΔωG can be found as follows:

$$\Delta\omega GT = a1\omega s\Delta T + a2\omega s\Delta T + a3\omega s\Delta T + \ldots + ai\omega s\Delta T + \ldots aN\omega s\Delta T = \Sigma ai\omega s\Delta T \quad (i = 1 - N)$$

Here, T=NΔT, and

ΔωG=(1/N) Σaiωs (i=1−N)

In the above expression, ωs has a polarity + or − according to the receiving level change. ai, which is a variable representing the polarity, represents the rotation direction of the antenna portion at a time i. It is determined, for example, that ai=+1 (clockwise) or ai=−1 (counterclockwise).

Figure 2:
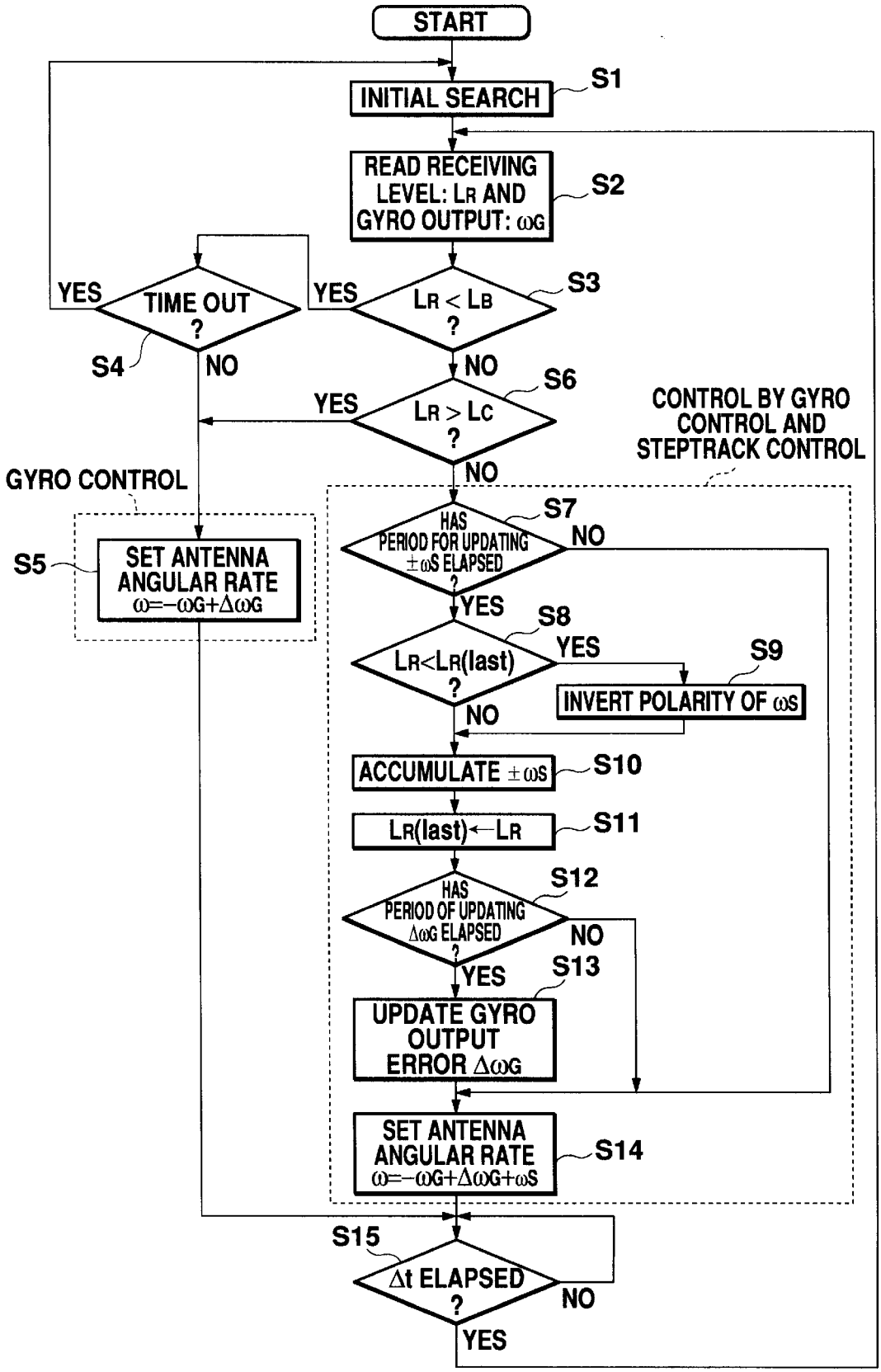
FIG. 2 is a flow chart showing the operation of the embodiment of the present invention.

The operation of the tracking antenna of this embodiment will be now described based on the flowchart shown in FIG. 2. In the following description, the antenna portion 10 consists of an array antenna having a sufficiently wide beam width in the elevation direction, and satellite tracking is performed only in the direction of azimuth.

"Initial Operation"

First, on turning on the system, an initial search is conducted (S1). In the initial search, the directional beam of the antenna portion 10 (array antenna) is rotated at a high speed while monitoring the receiving level LR. At a point in time when the receiving level exceeds the predetermined threshold value, the rotation of the antenna portion 10 is stopped and the tracking operation starts. If the receiving level LR exceeds the threshold value from the first, it is decided that the azimuth of the beam is substantially directed toward the satellite and the process continues to the tracking operation. Further, the initial value of ΔωG may be set to 0 or any appropriate value previously stored.

"Decision of tracking control"

In the tracking operation, first, a receiving level LR outputted from the receiving level detection portion 16 and an angular rate signal (gyro output) ωG outputted from the angular rate sensor portion 14 are read out (S2). During the tracking operation, this detection process is performed at control intervals Δt.

Then, it is decided whether or not the receiving level LR is less than a threshold value LB (S3). The threshold value LB is set to a relatively small value. If the receiving level LR is less than this threshold value LB, it is decided that a radio wave from the satellite is blocked. If the receiving level is less than the threshold value LB at S3, it is decided whether or not a timer, which was activated when the blocking condition was first found, indicates a time-out (S4). That is, it is decided whether or not the blocking condition has continued for a predetermined time period. If the time-out is detected at S4, it is then decided that tracking of the satellite is disabled, and the process returns to S1 for conducting the initial search.

"gyro control"

On the other hand, if the time-out is not detected at S4, an antenna angular rate is set for the gyro control (S5) and the tracking of the satellite is performed by using the set angular rate ω. Specifically, on the basis of the angular rate signal ωG outputted from the rate sensor 14, the beam is orientated in the direction represented by the opposite polarity of ωG for tracking the satellite. More specifically, the angular rate ω for driving the antenna is found by the following expression, and the antenna is controlled such that the beam rotates in the opposite direction of the rotation of the mobile so as to be continuously directed toward the satellite. With regard to the rotation direction of the antenna, it is previously determined that, for example, if ω is a positive value, rotation is clockwise, and if ω is a negative value, the rotation is counter-clockwise.

$\omega=-\omega G+\Delta\omega G$

Here, $\Delta\omega G$ is an error of the angular rate sensor calculated as already described. Since this error has been compensated, the tracking control using the gyro control is highly accurate. Therefore, there is only a slight possibility of losing the satellite, even when the gyro control is performed for a long time.

At S3, if the receiving level is equal to or greater than the threshold value LB, it is decided that a radio wave is not being blocked. Then, the receiving level LR is compared to a threshold value Lc (S6). If the receiving level is greater than the threshold value Lc, it is decided that the satellite can be seen and that the beam of the antenna is substantially orientated toward the satellite. If such a determination is made, it is not necessary to change the direction of the antenna beam. Then, the process continues to the gyro control (S5) already described, where the antenna beam is controlled on the basis of the angular rate signal $\omega G$ outputted from the angular rate sensor portion 14.

"Control operation using both the gyro control and the step track control"

If LR<Lc at S6, that is, $LB \leqq LR \leqq Lc$, a control operation is performed by using both the step track control and the gyro control. In this control operation, it is first decided whether or not the control amount $\pm\omega s$ for the step track control should be updated (S7).

Figure 3:
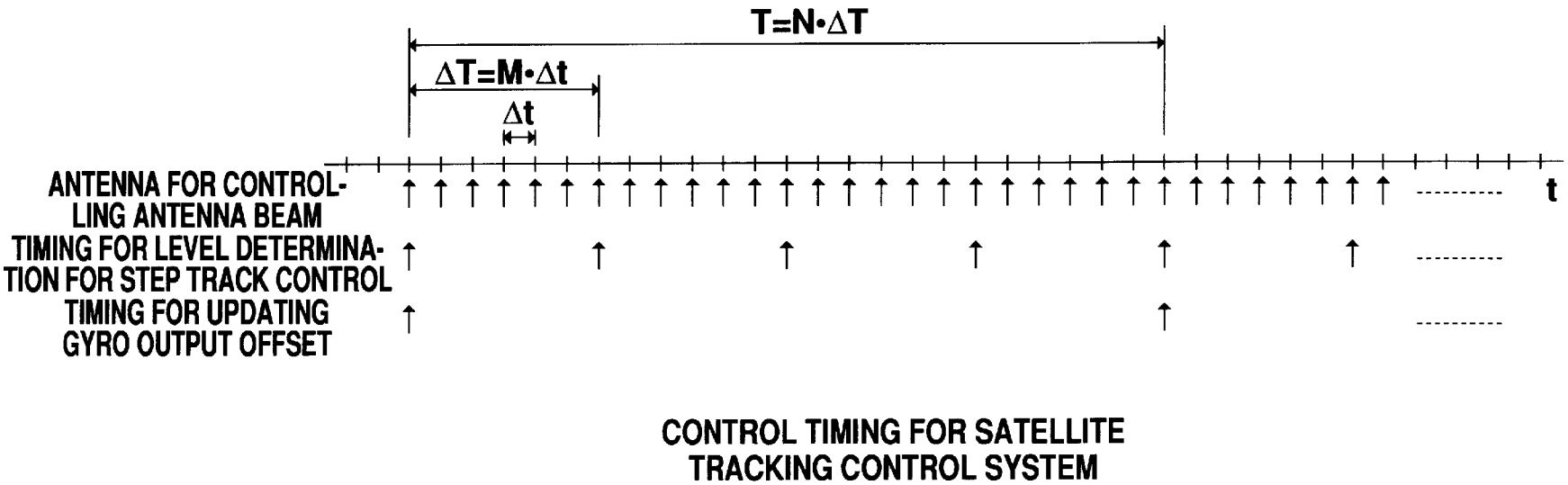
FIG. 3 is a diagram for explaining the control timing in accordance with the embodiment of the present invention.

Now, the control timing for the gyro control and the step track control will be described with reference to FIG. 3. In the gyro control, an interval between each control operation is $\Delta t$, and the beam is controlled based on an angular rate signal $\omega G$ basically at control intervals of $\Delta t$. In the step track control, the control interval is $\Delta T$ ($\Delta T=M\Delta t$), and the control operation is performed for every M gyro control operations. $\pm\omega s$ is updated for every $\Delta T$.

The error $\Delta\omega G$ is calculated from the results of a plurality of step track control operations. For example, $\Delta\omega G$ is obtained from the accumulated $\omega s$ value obtained by N step track operations. Thus, the calculation cycle of the error $\Delta\omega G$ is $N\Delta T=MN\Delta t$, which also represents the update timing for $\Delta\omega G$.

At S7, if the timing period for updating $\pm\omega s$ has elapsed, that is $M\Delta t$, the current receiving level LR and the receiving level LR(last) at a time $\Delta T$ before the current time, ($\Delta T$ is a control interval in the step track control), are compared to each other (S8). If LR is less than LR(last), the polarity of $\omega s$ is inverted (S9). If LR is equal to or greater than LR(last), the polarity of the outputted $\omega s$ is maintained.

Then, $\pm\omega s$, whose polarity has or has not been inverted, is added to the currently accumulated value (at S10). At the same time, the LR(last) is replaced by the current LR (at S11).

Next, it is examined whether or not timing period for updating $\Delta\omega G$ has elapsed, that is, $N\Delta T$ (S12). If the update timing period has elapsed, the outputted error $\Delta\omega G$ is updated (S13). Specifically, the accumulation result, obtained by accumulating $\pm\omega s$ for every $\Delta T$ for a time period of $N\Delta T$, is divided by N. The result is then added to an error $\Delta\omega G$ to obtain a new error $\Delta\omega G$. After $\Delta\omega G$ is calculated at S13, or if the update timing period for $\Delta\omega G$ has not elapsed at step 12, the antenna angular rate $\omega$ is set as follows (S14):

$\omega=-\omega G+\Delta\omega G+\omega s$

Specifically, the antenna angular rate $\omega$ is set by adding the step angular rate $\omega s$, whether its polarity has been inverted at S9 or not, and the new error $\Delta\omega G$ to the angular rate $\omega G$ used for the gyro control.

The rotational drive portion 12 is then controlled according to thus obtained antenna angular rate $\omega$, so that the antenna portion 10 is rotated to control the beam direction of the antenna. In this manner, the control operation is performed by using both the gyro control and the step track control.

If the gyro control is performed at S5, or if the control is performed by using both the gyro control and the step track control at S14, the process is suspended until the time $\Delta t$ (control interval) has elapsed (S15), and then returns back to S2 for detecting the receiving level and the angular rate. The above control procedure will then be repeated.

As described, the control process is performed, in which $\omega G$ is updated at control intervals of $\Delta T$ while the polarity of $\omega s$ is updated at control intervals of $\Delta T$.

In the above-described embodiment, the control procedure starting at S7 by using both the gyro control and the step track control, is performed only if $LB \leqq LR \leqq Lc$.

As described, in this embodiment, a satellite tracking system using both the step track control and the gyro control is provided with a function for calculating an error $\Delta\omega G$ contained in an angular rate $\omega G$ outputted from the rate sensor portion 14. For this calculation, a step angular rate signal $\pm\omega s$ outputted for the step track control is used, and the result is then used for correcting the angular rate $\omega G$. It is thus possible to reduce the possibility of losing the satellite, even if the gyro control is performed when the radio wave blocking conditions exist. Also, the satellite tracking can be appropriately performed even if a relatively inexpensive rate sensor 14 containing some degree of error is used.

Further, in this embodiment, two threshold values Lc and LB are provided (Lc>LB). The antenna control based on the gyro control is performed not only under the condition in which the receiving level LR is less than LB or radio wave blocking condition, but also under the condition in which LR exceeds Lc, i.e. the satellite can be seen and the beam direction of the antenna is substantially directed toward the satellite. As a result, the number of step track control operations can be reduced to a minimum, so that unnecessary control operations in the antenna beam direction during the step track control can be prevented. Therefore, it is possible to reduce the extent to which the receiving level is lowered. Also, an excellent image quality, especially in the case where a transmission signal is an image signal, can be obtained, even when the antenna system is used in a place where the peak value of the receiving level is low.

"Modified Embodiment"

Figure 4:
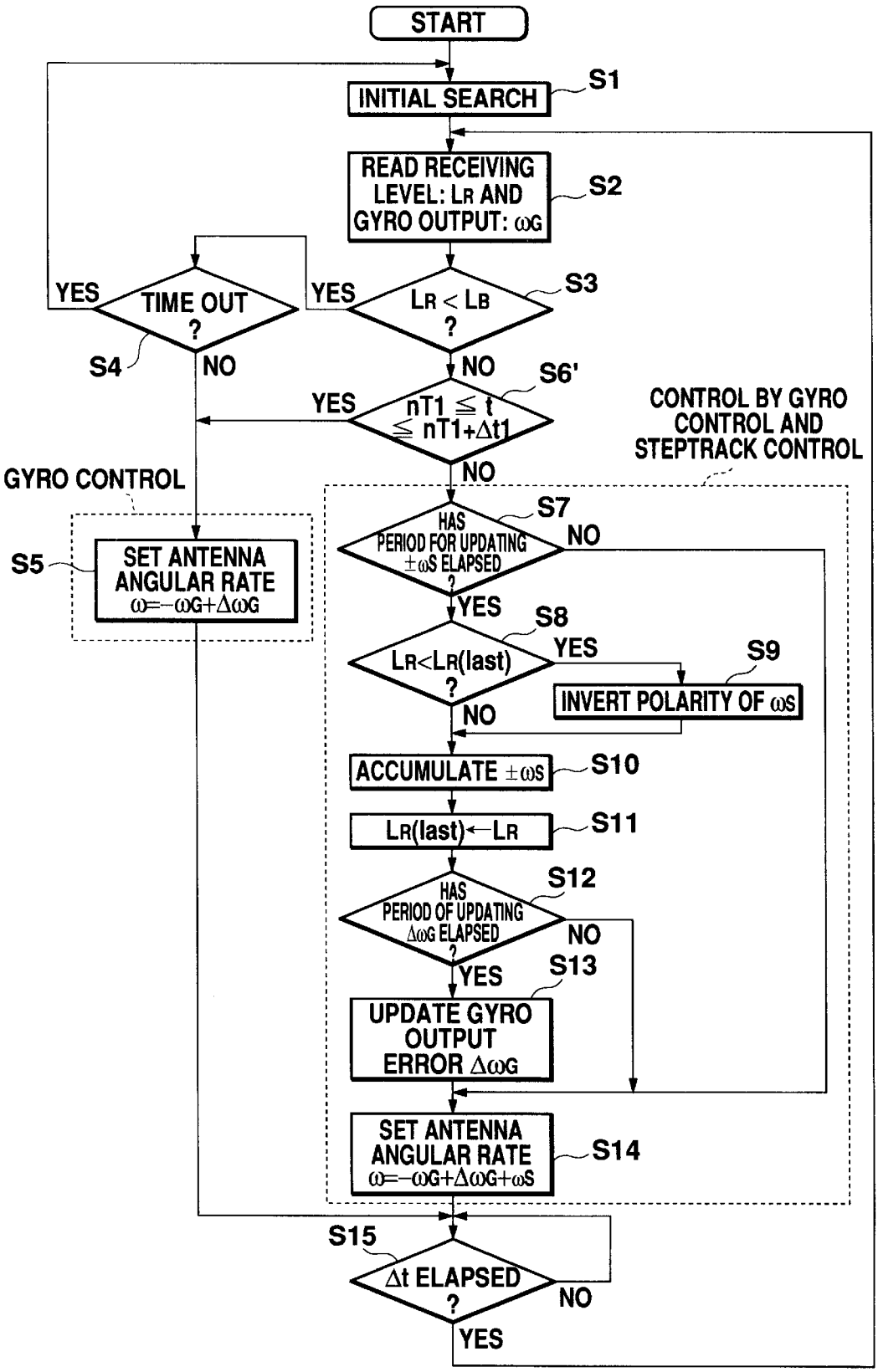
FIG. 4 is another flow chart showing the operation of a modified embodiment.

In the foregoing embodiment, under the condition where the satellite can be seen ($LR \geqq LB$), it is decided whether or not the control operation using both the gyro control and the step track control is performed, on the basis of the comparison result of a receiving signal LR and the threshold value Lc (S6 in FIG. 2). Alternatively, it may be decided whether or not $nT1 \leqq t \leqq nT1+\Delta t1$, as shown in S6' of FIG. 4. Here, n=1, 2, . . . , T1 is a time interval between each step track control, t represents the current time, and $\Delta t1$ is a time period during which the step track control is permitted. Thus, in this embodiment, according to the decision based not on the receiving level but on the elapsed time, the control operation using both the gyro control and the step track control is performed at predetermined intervals and within the predetermined time period.

Specifically, the elapsed time is measured by using a clock (not shown) which determines the control intervals for the gyro control and the step track control. Then, the step track control is permitted at relatively long time intervals T1, for example, for several tens of seconds to several minutes, and only within the predetermined time period $\Delta t1$, for example, ten times as long as ΔT in the above embodiment (10ΔT). In this manner, the control operation by both the gyro control and the step track control is performed (S6'). Since the error of the gyro output generally changes relatively slowly (at intervals of more than several minutes), the advantageous result similar to that in the above embodiment can be obtained, even if the operation using both gyro control and step track control is performed at predetermined time intervals as described above.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A tracking antenna system mounted on a mobile for tracking a radio source by controlling a beam direction of an antenna, comprising:

an angular change detector for detecting an angular change in an azimuth direction of the mobile;

a first controller for controlling the beam direction of the antenna in accordance with the angular change detected by the angular change detector;

a receiving level detector for detecting a receiving level of a radio wave;

a second controller for controlling the beam direction of the antenna by determining whether the receiving level of a radio wave detected by the receiving level detector increases or decreases;

an error detector for detecting an error contained in the angular change detected by the angular change detector on the basis of an accumulated amount of control performed by the second controller; and a corrector for correcting the angular change detected by the angular change detector by using the error detected by the error detector.

2. A tracking antenna system according to claim 1, wherein the error detector detects the error on the basis of a plurality of control operations performed by the second controller.

3. A tracking antenna system according to claim 2, wherein the second controller includes a step operation portion which generates a step angular rate signal having positive or negative polarity based on which the antenna is rotated in a positive or negative direction at a constant step angular rate, the polarity of the step angular rate signal being maintained as is when the receiving level increases when the antenna is rotated, the polarity being inverted when the receiving level decreases when the antenna is rotated; and the error detector includes an error estimator which accumulates a plurality of the step angular rate signals in order to calculate the error on the basis of the accumulated value of the step angular rate signals.

4. A tracking antenna system according to claim 3, wherein the error estimator accumulates the step angular rate signals for a predetermined period, and calculates an error by dividing the accumulated value by a number of accumulation operations.

5. A tracking antenna system according to claim 4, wherein the angular change detector is an angular rate detection sensor which detects an angular rate of the mobile from the angular change in the azimuth direction of the mobile.

6. A tracking antenna system according to claim 5, wherein the first controller rotates the antenna based on an inverted angular rate calculated by inverting polarity of the angular rate detected by the angular rate detection sensor.

7. A tracking antenna system according to claim 6, wherein the first controller generates an instruction for rotating the antenna based on the inverted angular rate at every predetermined control interval of Δt;

the second controller generates an instruction for rotating the antenna based on the step angular rate signal at every predetermined control interval of MΔt, where M is an integer;

the error detector updates the error at every predetermined interval of NMΔt, where N is an integer: and the rotation of the antenna is controlled on the basis of a sum of the inverted angular rate, the error, and the instruction generated by the second controller.

8. A tracking antenna system according to claim 1, further comprising a permission circuit for permitting the second controller to perform a control operation under a predetermined condition such that the control operation is performed for a permitted time period.

9. A tracking antenna system according to claim 8, wherein the permission circuit includes a determination circuit for determining whether the receiving level falls within a predetermined range, only the first controller performing a control operation when the determination circuit determines that the receiving level is outside the range.

10. A tracking antenna system according to claim 8, wherein the permission circuit includes a measurement circuit for measuring elapsed time in order that the second controller performs a control operation for only a certain period of time.

11. A tracking antenna system according to claim 1, wherein the receiving level detector detects the receiving level at every predetermined interval, and said second controller determines whether the receiving level of a radio wave detected by the receiving level detector increases or decreases by comparing the present receiving level with the prior receiving level.

12. A tracking antenna system mounted on a mobile for tracking a radio source by controlling a beam direction of an antenna, comprising:

first control amount generation means for generating, in accordance with an azimuth of the mobile, a first control amount for controlling the beam direction of the antenna;

receiving level detecting means for detecting a receiving level of a radio wave;

second control amount generation means for generating, by determining whether the receiving level of a radio wave detected by the receiving level detecting means increases or decreases, a second control amount for controlling the beam direction of the antenna;

direction control means for controlling the beam direction of the antenna on the basis of both the first and second control amounts; and correction means for calculating an error contained in the first control amount on the basis of an accumulated amount of the second control amount and correcting the first control amount based on the error.

* * * * *